US010436424B2

(12) United States Patent
Germain

(10) Patent No.: US 10,436,424 B2
(45) Date of Patent: Oct. 8, 2019

(54) LINEAR LIGHT FIXTURE INTERCONNECT WITH ANTI-SNAKING FEATURE

(71) Applicant: GE Lighting Solutions, LLC, East Cleveland, OH (US)

(72) Inventor: Steve Germain, L'lle-Perrot (CA)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 64 days.

(21) Appl. No.: 15/614,734

(22) Filed: Jun. 6, 2017

(65) Prior Publication Data

US 2018/0135836 A1 May 17, 2018

Related U.S. Application Data

(60) Provisional application No. 62/423,577, filed on Nov. 17, 2016.

(51) Int. Cl.

| | |
|---|---|
| ***F21V 19/00*** | (2006.01) |
| ***H01R 33/94*** | (2006.01) |
| ***F21S 2/00*** | (2016.01) |
| ***F21V 21/005*** | (2006.01) |
| *F21S 8/06* | (2006.01) |
| *F21V 15/015* | (2006.01) |

(52) U.S. Cl.

CPC ..... *F21V 19/008* (2013.01); *F21S 2/00* (2013.01); *F21V 21/005* (2013.01); *H01R 33/942* (2013.01); *F21S 8/06* (2013.01); *F21V 15/015* (2013.01)

(58) Field of Classification Search

CPC .... F21V 19/008; F21V 21/005; F21V 15/015; F21S 2/00; F21S 8/06; H01R 33/942

See application file for complete search history.

(56) References Cited

U.S. PATENT DOCUMENTS

| | | | | |
|---|---|---|---|---|
| 5,241,460 A * | 8/1993 | Schonbek | F21V 5/06 | 362/339 |
| 6,220,731 B1 * | 4/2001 | Ryan | F21V 9/08 | 362/217.07 |
| 2014/0369061 A1 * | 12/2014 | Kim | F21S 2/00 | 362/543 |
| 2015/0022094 A1 * | 1/2015 | Hayman | F21V 7/005 | 315/152 |

* cited by examiner

*Primary Examiner* — Kevin Quarterman

(74) *Attorney, Agent, or Firm* — Buckley, Maschoff & Talwalkar, LLC

(57) ABSTRACT

Provided is a light fixture including an end portion that features a mechanism configured to lock the light fixture via the end portion to another end portion disposed at one extremity of another light fixture. The mechanism also includes a lever configured to lock the light fixture with the other end portion.

16 Claims, 23 Drawing Sheets

600

1202

1204

LINEAR LIGHT FIXTURE INTERCONNECT WITH ANTI-SNAKING FEATURE

CROSS-REFERENCE TO RELATED APPLICATIONS

The present disclosure claims the benefit of U.S. Provisional Patent Application No. 62/423,577, filed on Nov. 18, 2016, the content of which is incorporated herein in its entirety by reference.

TECHNICAL FIELD

The present disclosure relates to linear light fixtures. More particularly, the present disclosure relates to linear light fixtures including interconnects that comprise anti-snaking features.

BACKGROUND

Linear light fixtures are often suspended from a ceiling and attached together to form a continuous run of fixtures. Further, when used in commercial spaces, the fixtures are mounted far from the ground (e.g., about 10 to 20 feet). As such, it may become difficult for a technician to install the fixtures. Therefore, there can be many obstacles at the ceiling, which can complicate the installation.

Furthermore, linear light fixtures are often suspended using aircraft cables. A misalignment of the mounting points of these cables may cause the light fixtures to be at an angle with respect to each other, thus causing an undesirable effect referred to in the industry as "snaking." Put simply, snaking occurs when a continuous run of light fixtures is not perfectly straight, as result of each light fixture in the run being at an angle with respect to the other. This misalignment can yield an undulating pattern, similar to the body of a snake during motion. Snaking is unpleasing to the eye, and typical linear light fixture solutions do not provide mechanisms that prevents snaking without compromising installation ease and duration.

SUMMARY

The embodiments featured herein help solve or mitigate the above noted issues as well as other issues known in the art. Specifically, the embodiments provide means for preventing snaking without making installation more complex. For example, the embodiments provide a tool-less solution to the snaking effects typically observed in continuous runs of linear light fixtures.

For example, one embodiment provides a light fixture that includes an end portion that comprises a mechanism configured to lock the light fixture via the end portion to another end portion disposed at one extremity of another light fixture. The mechanism includes a lever configured to lock the light fixture with the other end portion.

Another exemplary embodiment provides a light fixture assembly that includes a set of light fixtures comprising at least one light fixture having one end connected to another light fixture. The light fixture assembly further includes a mechanism disposed between the end of the at least one light fixture and the other light fixture. The mechanism includes a lever configured to lock the light fixture with the other end portion.

Another exemplary embodiment includes a mechanism for providing anti-snaking between a first light fixture and a second light fixture. The mechanism includes a lever adaptable to mount on either an end of the first light fixture or an end of the second light fixture. The lever is configured to lock the first and the second light fixtures in a substantially snaking-free position when actuated in one direction.

Additional features, modes of operations, advantages, and other aspects of various embodiments are described below with reference to the accompanying drawings. It is noted that the present disclosure is not limited to the specific embodiments described herein. These embodiments are presented for illustrative purposes only. Additional embodiments, or modifications of the embodiments disclosed, will be readily apparent to persons skilled in the relevant art(s) based on the teachings provided.

BRIEF DESCRIPTION OF THE DRAWINGS

Illustrative embodiments may take form in various components and arrangements of components. Illustrative embodiments are shown in the accompanying drawings, throughout which like reference numerals may indicate corresponding or similar parts in the various drawings. The drawings are only for purposes of illustrating the embodiments and are not to be construed as limiting the disclosure. Given the following enabling description of the drawings, the novel aspects of the present disclosure should become evident to a person of ordinary skill in the relevant art(s).

Figure 1:
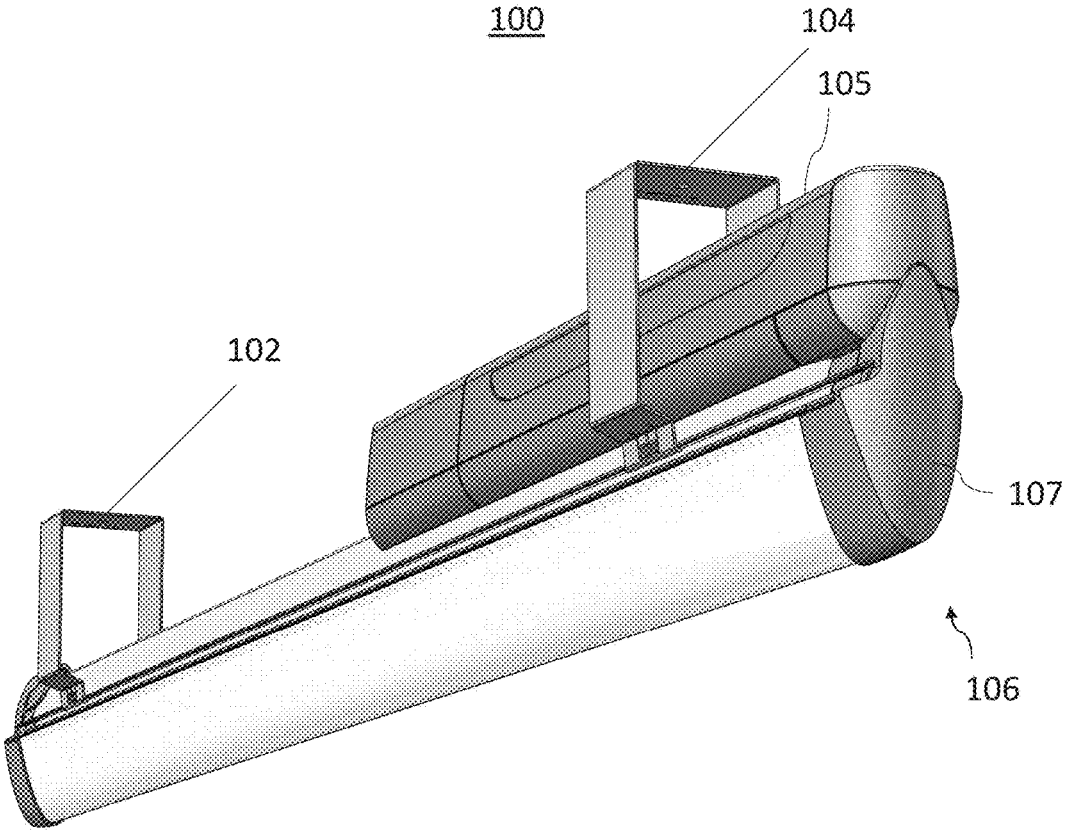
FIG. 1 illustrates a view of a linear light fixture according to various aspects described herein.

The drawings are only for purposes of illustrating preferred embodiments and are not to be construed as limiting the disclosure. Given the following enabling description of the drawings, the novel aspects of the present disclosure should become evident to a person of ordinary skill in the art. This detailed description uses numerical and letter designations to refer to features in the drawings. Like or similar designations in the drawings and description have been used to refer to like or similar parts of embodiments of the invention.

DETAILED DESCRIPTION

While the illustrative embodiments are described herein for particular applications, it should be understood that the present disclosure is not limited thereto. Those skilled in the art and with access to the teachings provided herein will recognize additional applications, modifications, and embodiments within the scope thereof and additional fields in which the present disclosure would be of significant utility.

The embodiments combine several functionalities to provide a tool-less means of achieving alignment, locking, and anti-snaking of a first light fixture to a second light fixture. For example, the embodiments provide a tool-less interconnect (i.e., a tool-less interconnect) for connecting two light fixtures together. The interconnect (i.e., the mechanism of connection between the two fixtures) includes an integrated anti-snaking feature, which is embodied in the form a lever. The tool-less attachment function is achieved by mechanically attaching the two fixtures together by actuating the lever from an "Open" position to a "Center Lock" position.

In one embodiment, the "Open" position is when the lever is completely rotated to the left (clockwise) or to the right (counter-clockwise). The "Center Lock" position is when the Lever is rotated is the central vertical position. In this position, there is a locking feature that will automatically stop the lever thus making it easier to reach.

Another feature provided by the embodiments is an "anti-snaking" feature. This feature will act as wedge by adding some thickness to the lever on one side of the lever while decreasing the thickness on the other side simultaneously. This is done by slightly rotating the Lever from the "Center Lock" position to one side or the other. This will cause the junction of the 2 fixtures to be forced in one direction or the other.

When the suspension points of the aircraft cables that supports the fixtures are not perfectly installed in a straight line, the anti-snaking feature can be used to bring back the junction of two linear lighting fixtures. This will eliminate the angle between the two fixtures to yield a perfectly aligned installation. The following descriptions show several exemplary embodiments which describe the aforementioned features and functions.

FIG. 1 illustrates a view of a linear light fixture 100 according to various aspects described herein. The fixture 100 includes the brackets 102 and 104 from which the fixture 100 can hang from a ceiling via aircraft cables (not shown). The fixture 100 further includes a power supply box 105 housing power supply equipment and lighting driver controls for controlling the lighting within the linear light fixture 100 and an end portion 106 that comprises a removable cap 107 that can be removed in order to mate the light fixture 100 with another similar light fixture.

Figure 2:
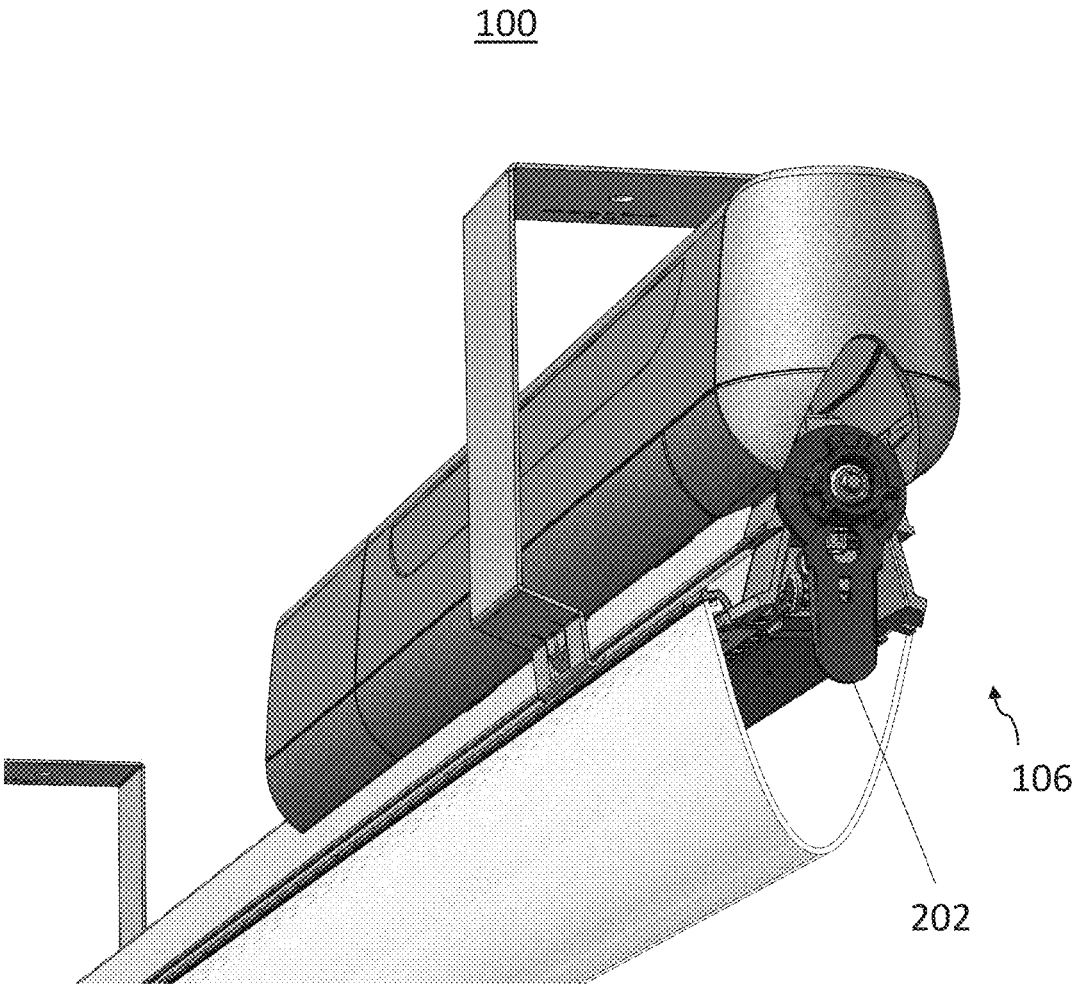
FIG. 2 illustrates a view of a linear light fixture according to various aspects described herein.
Figure 3:
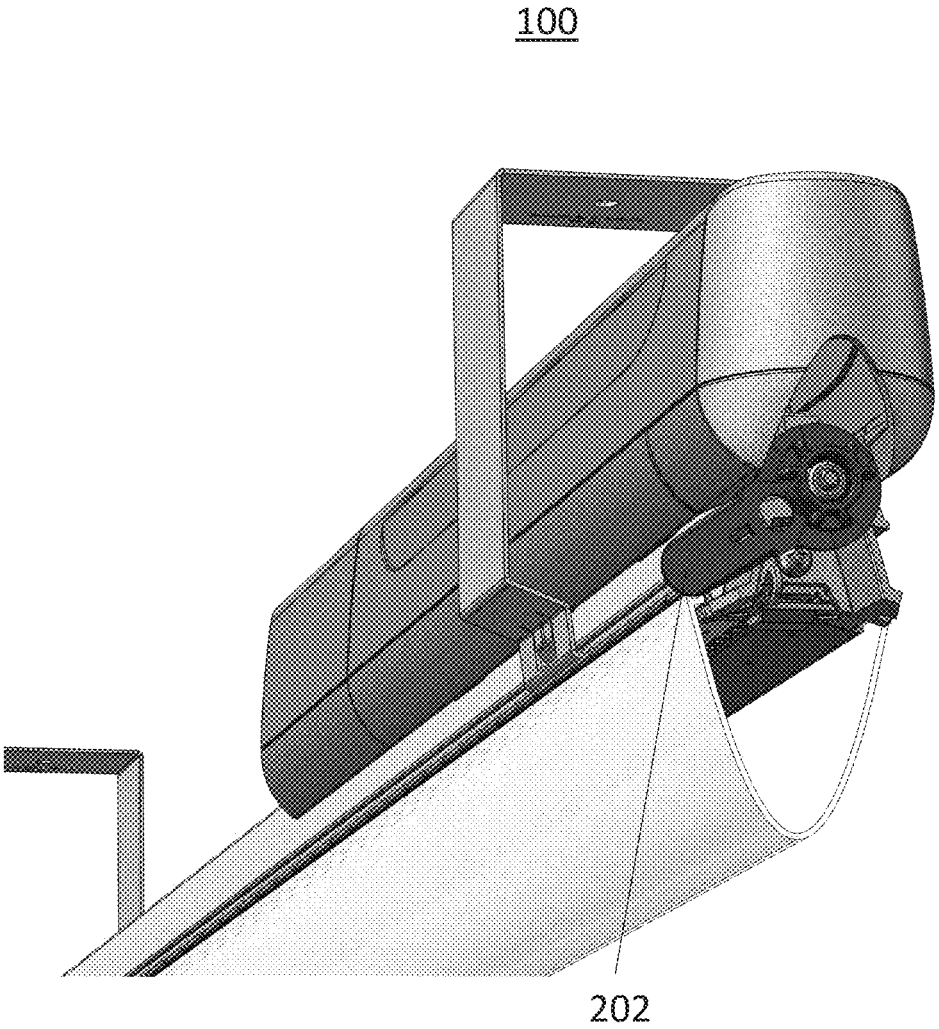
FIG. 3 illustrates a view of a linear light fixture according to various aspects described herein.

FIG. 2 shows a view the light fixture 100 with the cap 107 removed from the end portion 106, thus showing a lever 202 that is configured to perform the aforementioned function. Specifically, the lever 202 is configured to provide tool-less attachment of the light fixture 100 to another similar light fixture, and it is also configured to provide an anti-snaking fixture between the two connected light fixtures. To release two connected linear light fixtures 100 or to get the linear light fixtures 100 ready for connection, the lever 202 can be rotated off-center either to left or to the right, as shown in in FIG. 3

Figure 4:
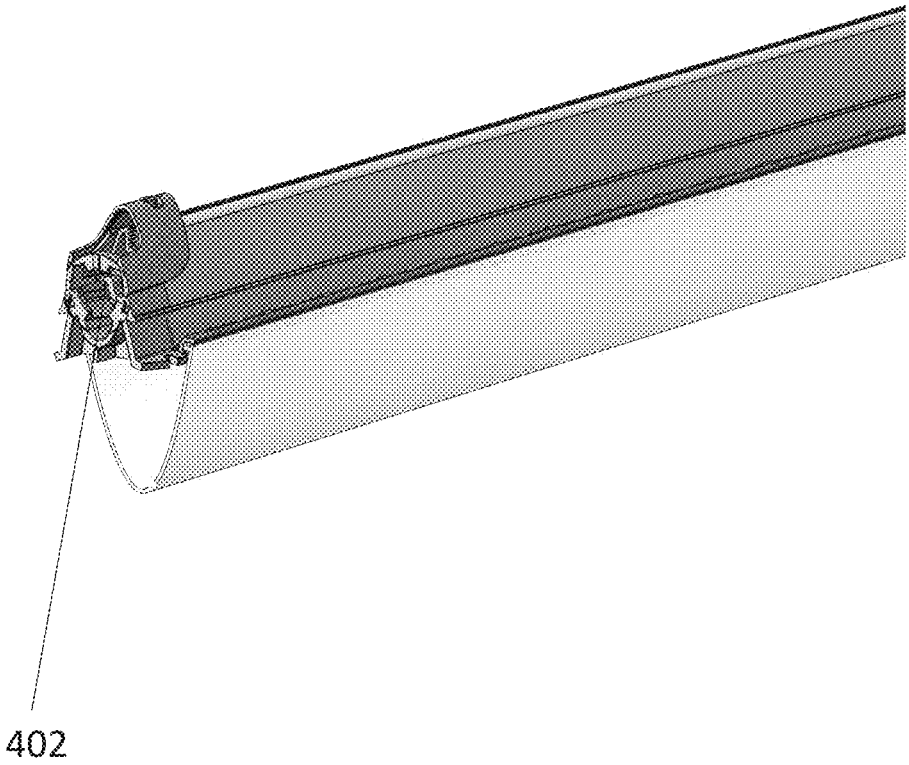
FIG. 4 illustrates a view of a linear light fixture according to various aspects described herein.

FIG. 4 illustrates a view 400 of the linear light fixture 100, with the cap remove from the 106. As shown in FIG. 4, the end portion 106 includes a receiving component 402 that is shaped and sized adequately to receive and secure the lever 202. While a specific configuration is shown in FIG. 4, one of skill in the art will readily appreciate that other shapes and relative sizes are contemplated.

Figure 5:
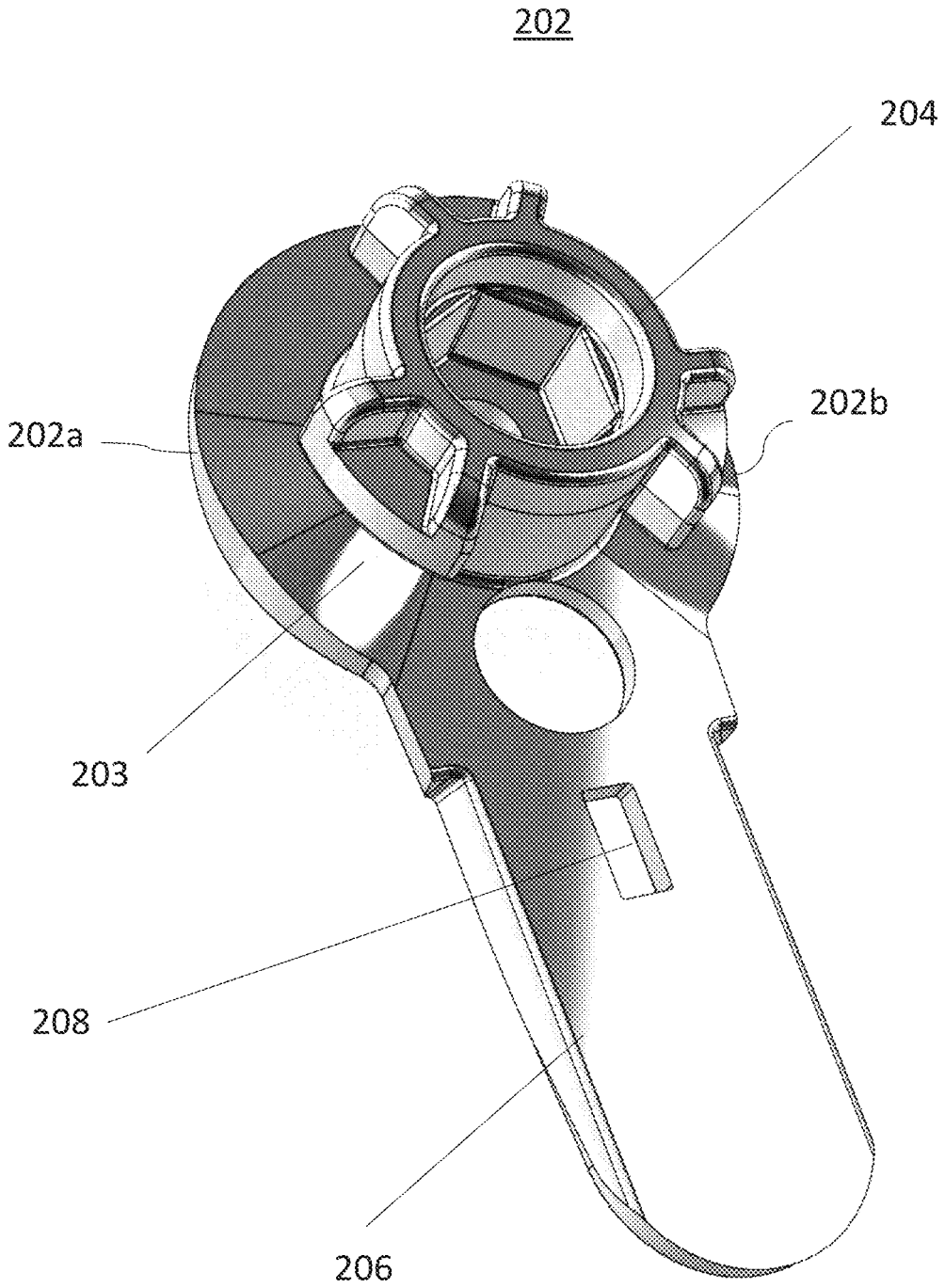
FIG. 5 illustrates a component of light fixture assembly according to various aspects described herein.

FIG. 5 illustrates the lever 202 according to an exemplary embodiment. The lever 202 includes a first portion 203 that includes on either side of the lever 202 a component 204 that is configured to mate with the receiving component 402 of the linear fixture 100. The lever 202 further includes a second portion 206 that includes a feature 208 that is configured to engage a feature 1102 (in FIG. 11) of the end portion 106 to secure two linear light fixtures 100 together.

Figure 6:
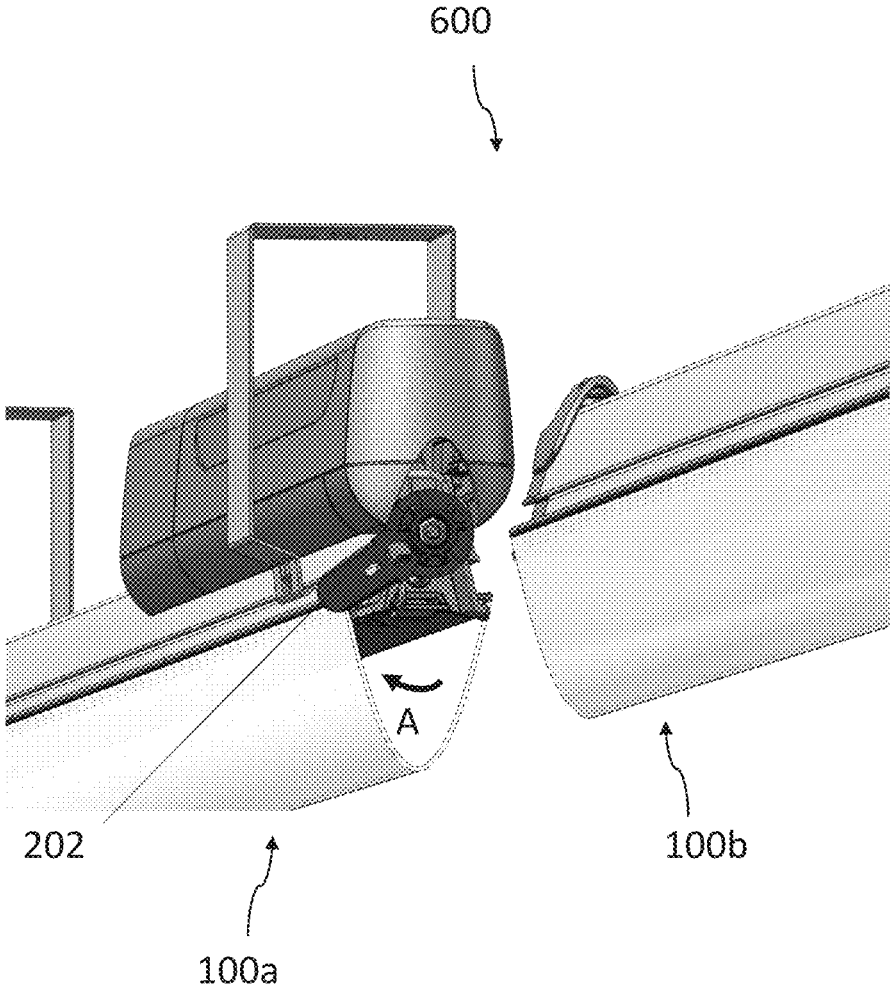
FIG. 6 illustrates an assembly of two linear light fixtures according to various aspects described herein.
Figure 7:
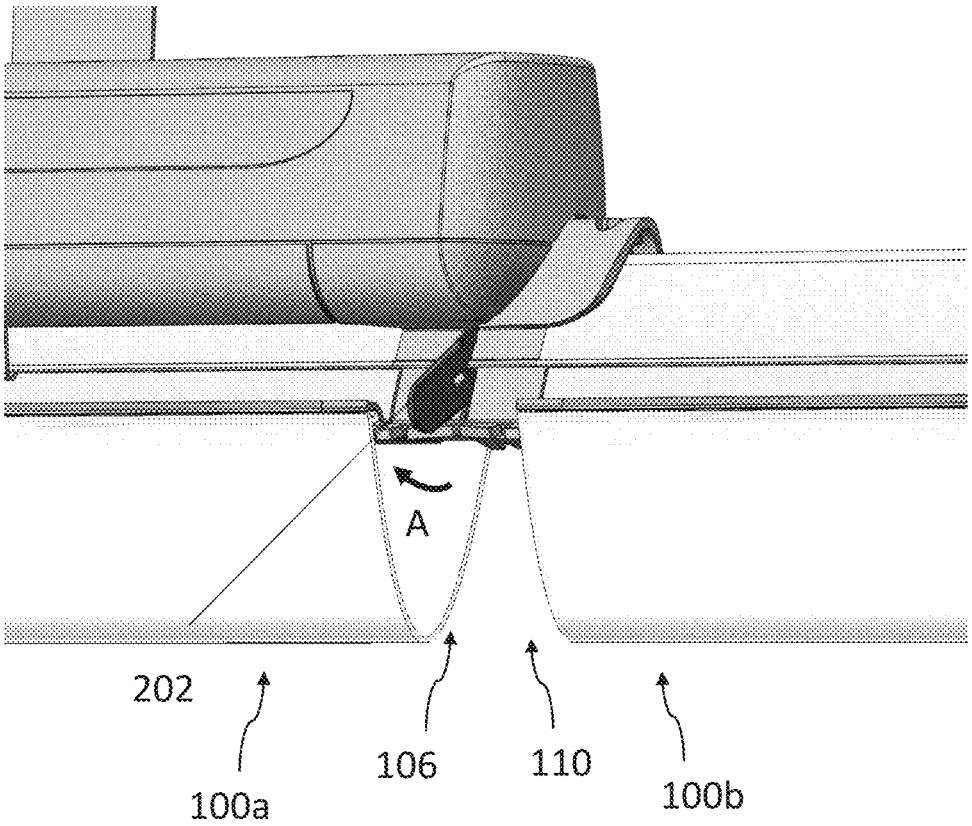
FIG. 7 illustrates an assembly of two linear light fixtures according to various aspects described herein.

FIG. 6 shows a light fixture assembly 600 that includes two linear light fixtures 100 to be mated together with the lever 202 being put into an "Open" position as indicated by arrow 'A'. In FIG. 7, the two linear light fixtures 100*a* and 100*b* are brought into contact while lever 202 is still in the "Open" position as indicated by the arrow 'A'. The male side end portion 106 of light fixture 100*a* is brought into contact with the female side end portion 110 of the other light fixture 100*b*.

Figure 8:
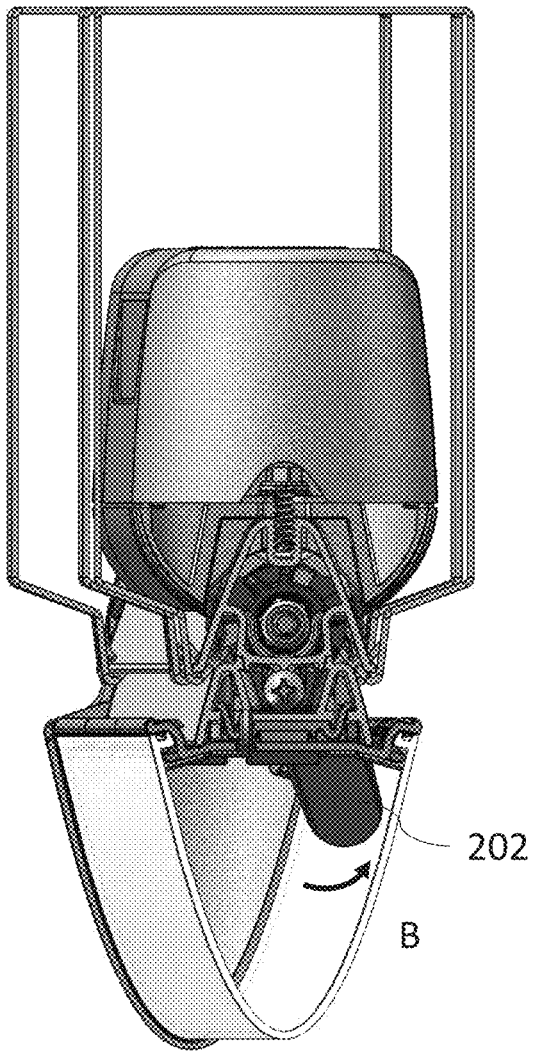
FIG. 8 illustrates a cross-sectional view of a linear light fixture assembly according to various aspects described herein.

In FIG. 8, after the two linear light fixtures 100 have been mated together, the lever is rotated to a "B" position which is the maximum adjusting position of the lever 202 to bring the two linear light fixtures 100 into approximately 180 degree plane, straight alignment with one another, according to an embodiment of the present invention. Further discussion regarding the adjustment range of the lever 202 will be discussed below with reference to FIG. 13.

Figure 9:
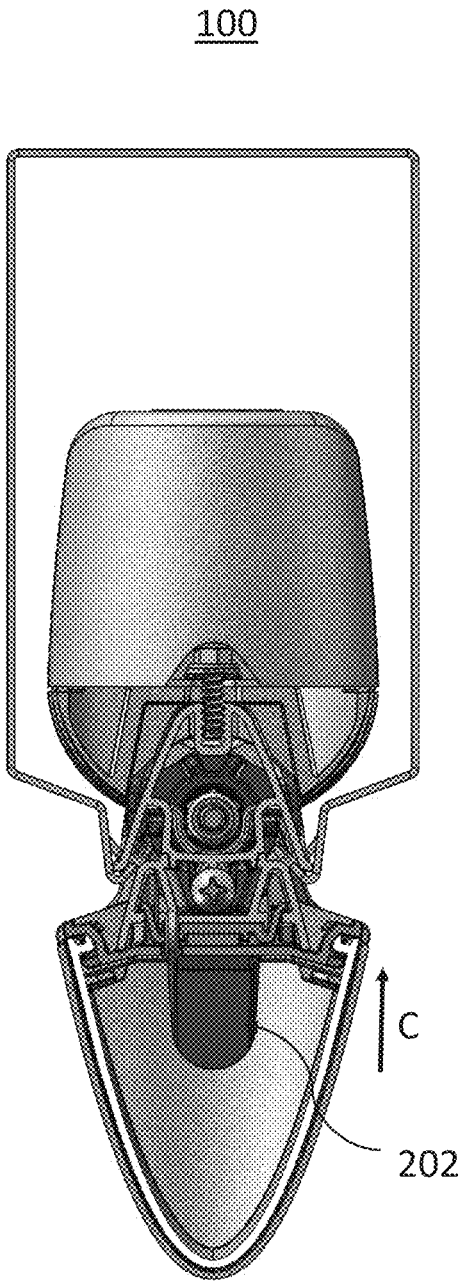
FIG. 9 illustrates a perspective view of a linear light fixture assembly according to various aspects described herein.
Figure 10:
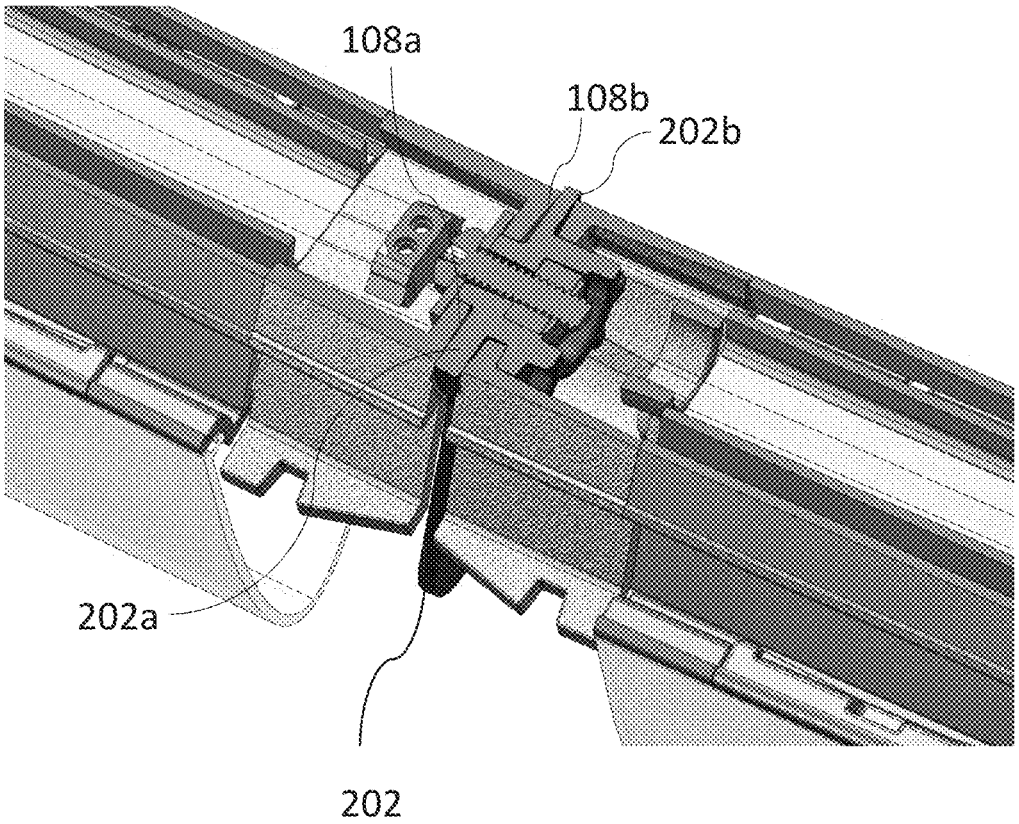
FIG. 10 illustrates a perspective view of a linear light fixture assembly according to various aspects described herein.

The lever 202 can then be actuated in the "Center Lock" position as indicated by arrow 'C', to lock the two linear light fixtures 100, as shown in FIG. 9. FIG. 10 illustrates a cutaway view of the lever 202 after the two linear light fixtures 100 have been mated together. As shown in FIG. 10, during the adjustment process, the more the lever 202 is rotated the thicker one opening 108*a* housing one side 202*a* of the lever 202 is compared to an opening 108*b* housing an opposite side 202*b* of the lever 202 due to the rotation thereof.

Figure 11:
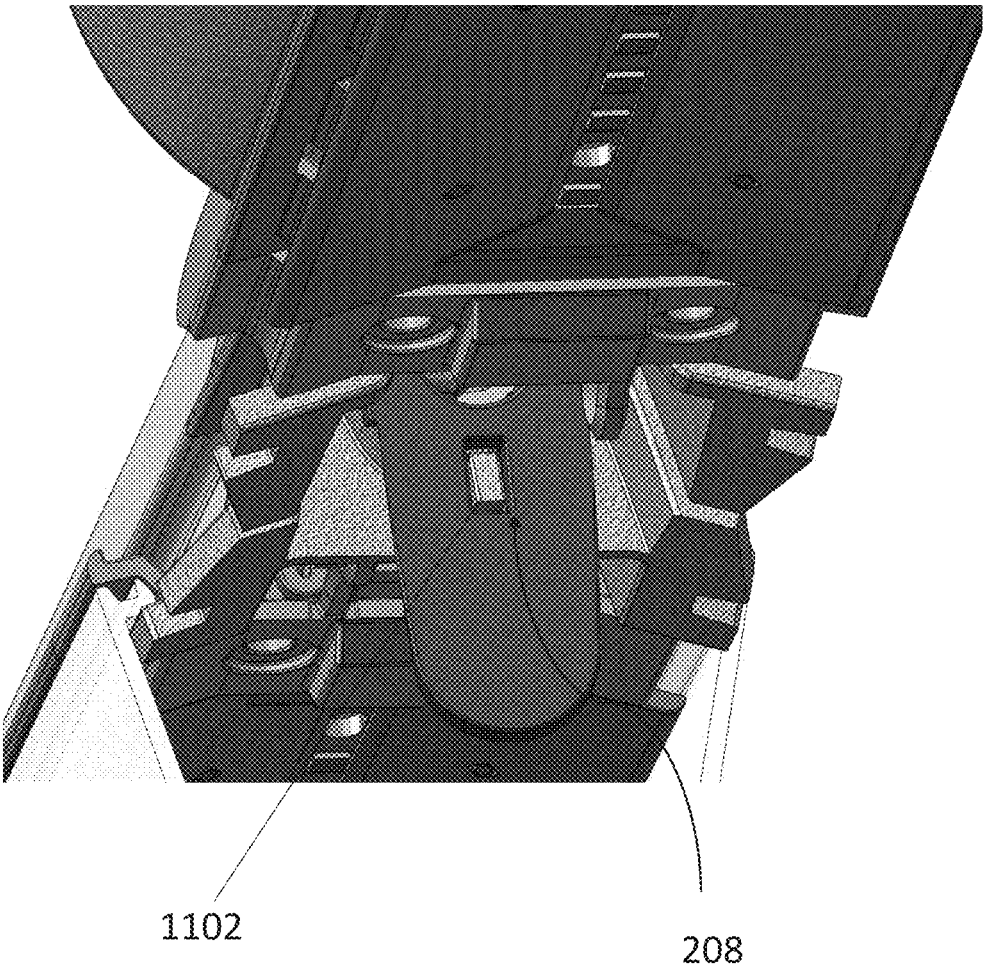
FIG. 11 illustrates a perspective view of a linear light fixture assembly according to various aspects described herein.

FIG. 11 shows the lever 202 in the "Center Lock" position with the feature 208 of the lever 202 and the feature 1102 of one end portion 106 (i.e., a male end portion of the light fixture) engaged with one another, thus locking the two linear light fixtures 100 in a straight line, thus correcting or compensating for the misalignment of the mounting points, thus eliminating snaking while also providing ease of installation as well as tool-less installation.

FIGS. 12A-12D illustrate a lever 1202 of an alternate embodiment of the present invention. As shown in FIG.

12A, the "Center Lock" feature 208 of the lever 202 is replaced by a multi-detent mechanism 1204 on the back-side of feature 1203 of the lever 1202. The lever 202 further includes sides 1205*a* and 1205*b* of varying thicknesses to facilitate adjustment of the alignment between two linear lighting fixtures when mated together. The lever 1202 further includes a handle 1206 to facilitate the adjustment thereof and a clearance opening 1208 for receiving a connecting mechanism (e.g., a bolt and nuts or screws) there through to connect the lever 1202 to an end portion 106 (i.e., the male end) of a linear light fixture.

Figure 12A:
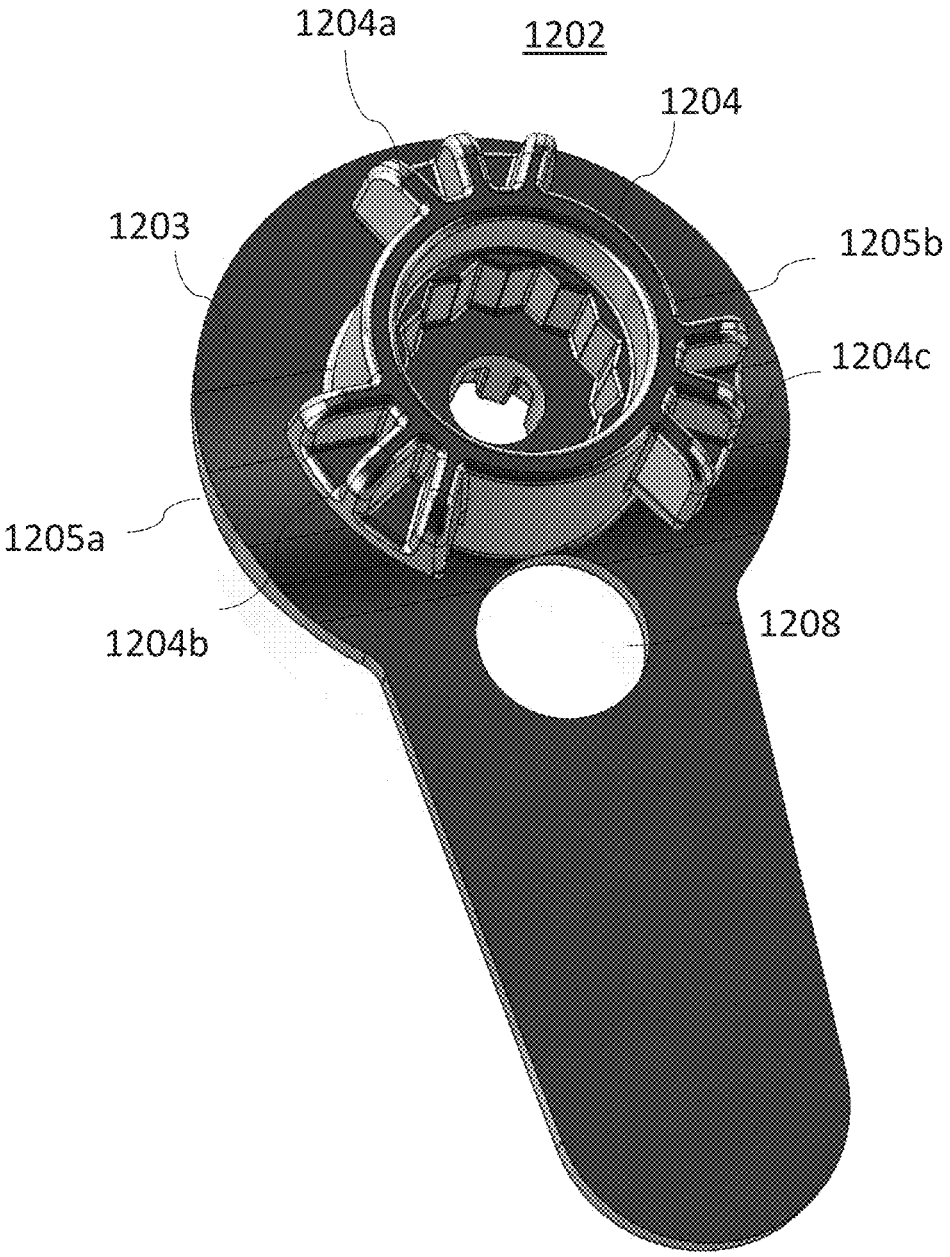
FIGS. 12A-12D illustrate various views of a lever according to various aspects described herein.
Figure 12B:
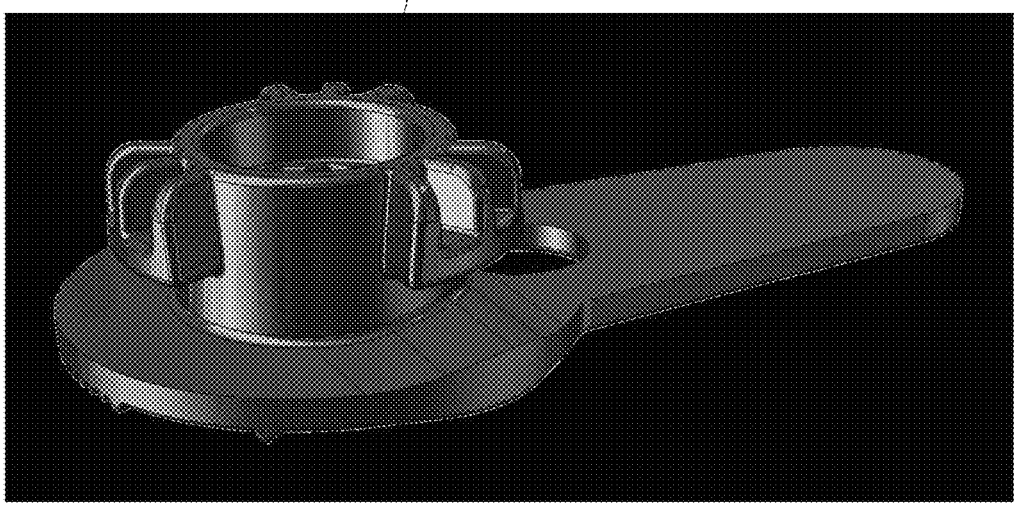

FIG. 12B further illustrates a perspective view of the lever 1202 showing the component 1204 on one side of the feature 1203, to be received at a receiving portion of the other linear light fixture.

Figure 12C:
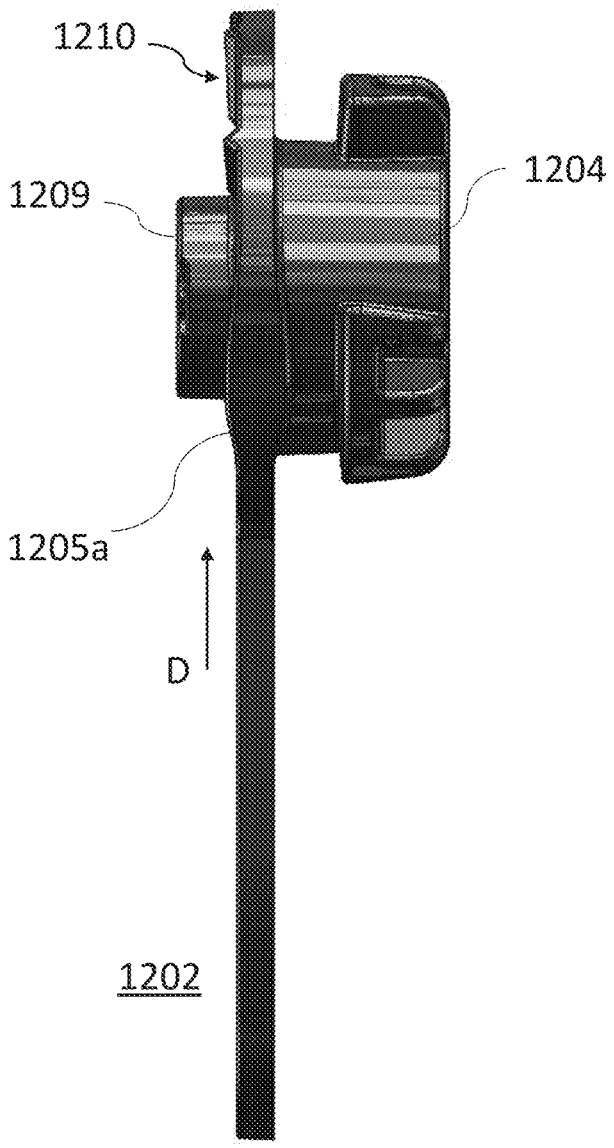

FIG. 12C illustrates a side view illustrated the component 1204 on one side (e.g., a front side) of the lever 1202 and a component 1209 and multiple detents 1210 on the opposite side (e.g., back side) of the lever 1202. The component 1209 is used to connect the lever 1202 to the first linear light fixture 100 and the component 1204 is used to connect the front end of the lever 1202 to the second linear light fixture 100. The component 1209 is formed such that even when the connecting mechanism is fully tighten, the lever 1202 is able to rotate freely (as shown in FIG. 10).

Figure 14:
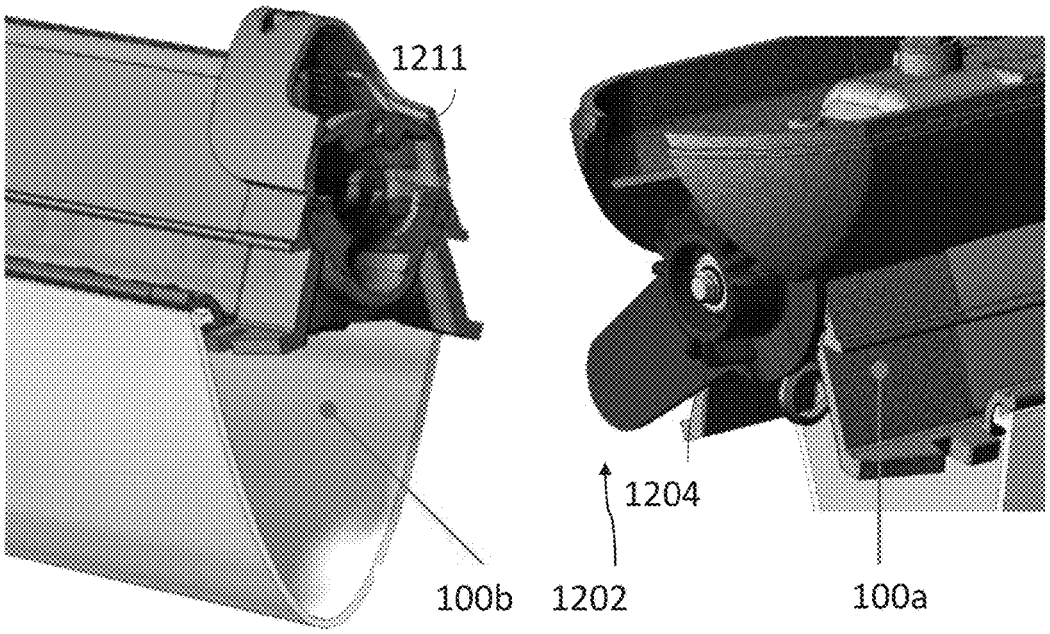
FIG. 14 illustrates a process for mating two linear light fixtures together according to various aspects described herein.

The component 1204 includes three (3) tabs equally spaced tabs 1204*a*, 1204*b* and 1204*c* that are designed to perfectly match the shape of the "female" side of the light fixture (as depicted in FIG. 14 (element 1211)). These three (3) tabs 1204*a*, 1204*b* and 1204*c* can only be inserted in component 1211 when the lever 1202 is positioned at the maximum clockwise or maximum anti-clockwise positions. Then, by rotating the lever 1202 at any other positions (including the anti-snaking position adjustment range), the lever 1202 will not be able to get out of the component 1211, thus the making the two linear light fixtures mechanically attached together. Further shown in FIG. 12C, the side 1205*a* is formed of a varying thickness along the vertical distance thereof as indicated by arrow 'D'.

According to embodiments of the present invention, the lever 1202 is formed so that the thickness will gradually increase and then decrease again on both sides 1205*a* and 1205*b*. The thickness variation is off-centered relative to the axe of rotation of the lever 1202. Thus, providing the following functionality for performing anti-snaking adjustment. The points of contact of the thicknesses on both sides 1205*a* and 1205*b* with the two linear light fixtures will occur at a vertical level that is coincident to the axis of rotation of the lever 1202.

Referring back to FIG. 10, in the horizontal cross-section of the junction of two linear light fixtures right on the axis of rotation of the lever 1202, the contact points of the features on both sides 202*a* and 202*b* with the two linear light fixtures. The end portion 106 (as depicted in FIG. 2) of the linear light fixture 100 is formed so the contact will only occur on this plane. Thus, the lever 1202 only provides a side force to correct to snaking of the linear light fixtures and does not introduce any undesirable vertical forces.

Further, when the lever 1202 is at the central neutral position, the apparent thickness at sides 1205*a* and 1205*b* (which is the portion that comes into contact with the end of both linear light fixtures) is the same on both sides, so there are no lateral forces induced to the junction. In addition, when the lever 1202 is rotated, the apparent thickness will then be bigger on one side 1205*a* and smaller on the other side 1205*b* simultaneously. The thickest side (e.g., 1205*a*) will induce some lateral force to the fixture junction to compensate for the any snaking. The thinnest side (e.g., 1205*b*) will create some space on the opposite side (e.g., 1205*a*) to allow the mechanism to work freely.

Figure 12D:
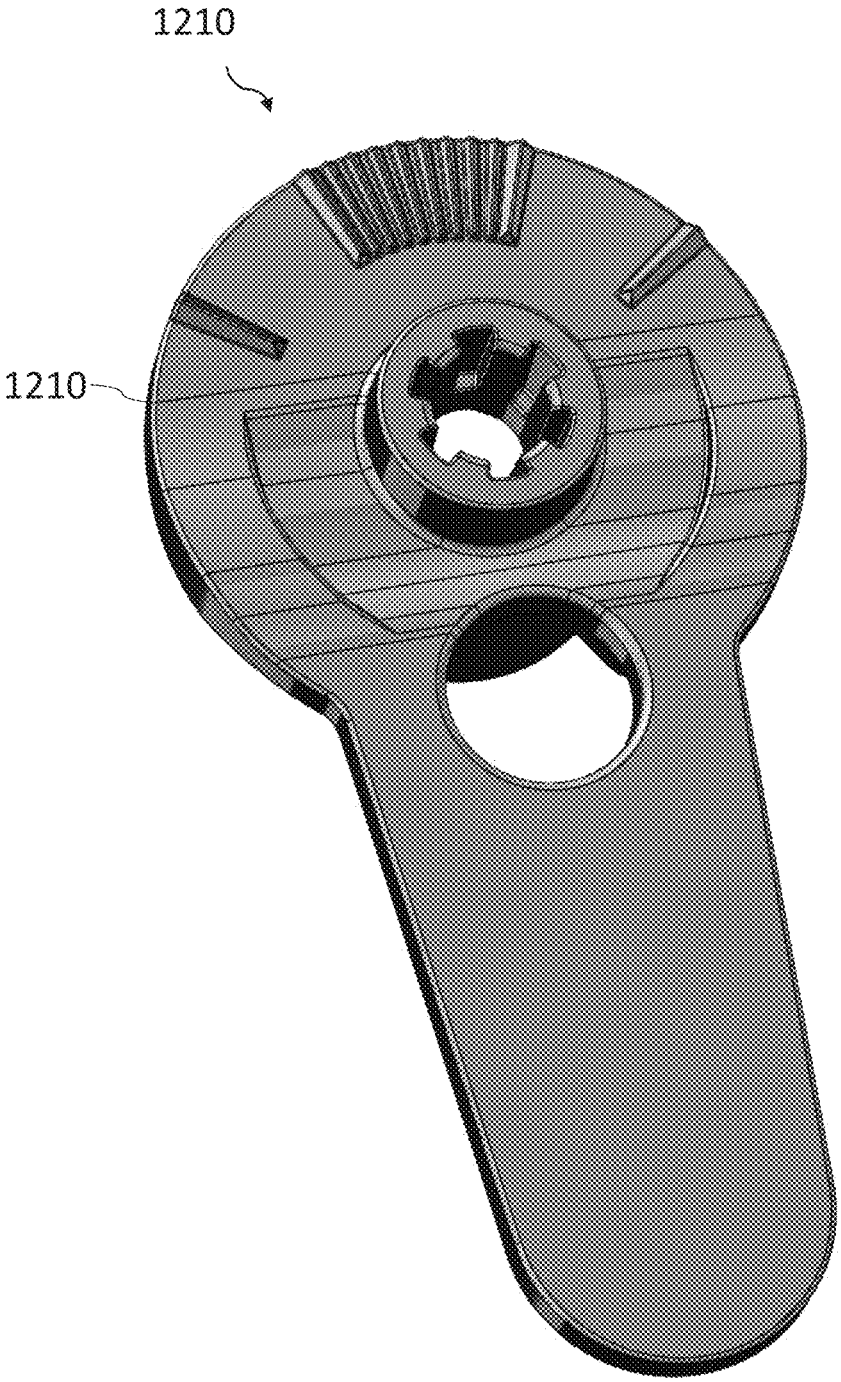

FIG. 12D illustrates the detents 1210 to facilitate adjustment of the lever 1202. As shown in the detailed view of FIG. 13, the central small detents (A) define an adjustment zone of the anti-snaking feature, thus defining a usable range for the snaking compensation. The bigger detents (B) are there so that an installer can detect when the lever 1202 is brought to the maximum adjustment zone. Further, the big outside detents (C) are there to maintain the lever 1202 in the open position. This allows the installer to bring the two linear light fixtures together without having to keep the lever 1202 in the open position. If B detent is passed, the lever 1202 outside the adjustment range and an unlock position.

The center region of the detents (A) forms a central, neutral position of the lever 1202 which is also referred to herein as the "Center Lock" position.

In FIG. 14, a male side of a first linear light fixture 100*a* is mated with a female side of a second linear light fixture 100*b* having a receiving portion 1211 for receiving the component 1204 of the first linear light fixture 100*a*.

Figure 15A:
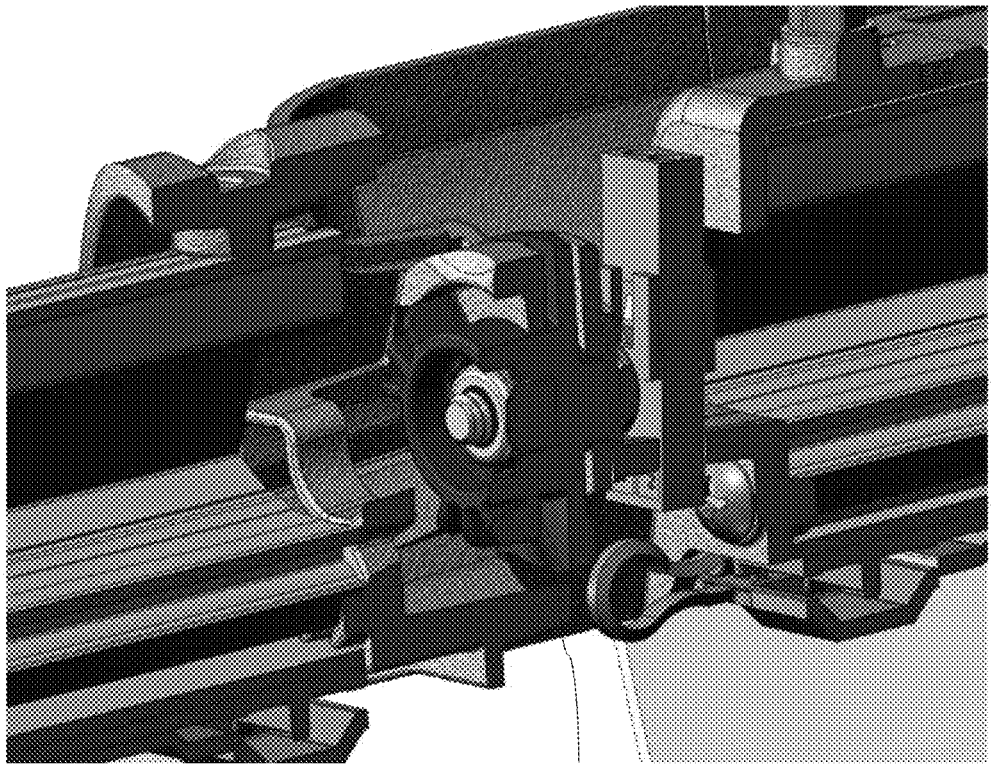
FIGS. 15A and 15B illustrate cutaway views of the lever shown in FIGS. 12A-12D in an open position and closed positions respectively, while mounted between the two linear light fixtures according to various aspects described herein.

In FIG. 15A, as shown in the cutaway view, the first and second linear light fixtures 100*a* and 100*b* are brought together while the lever 1202 is in an open position.

Figure 15B:
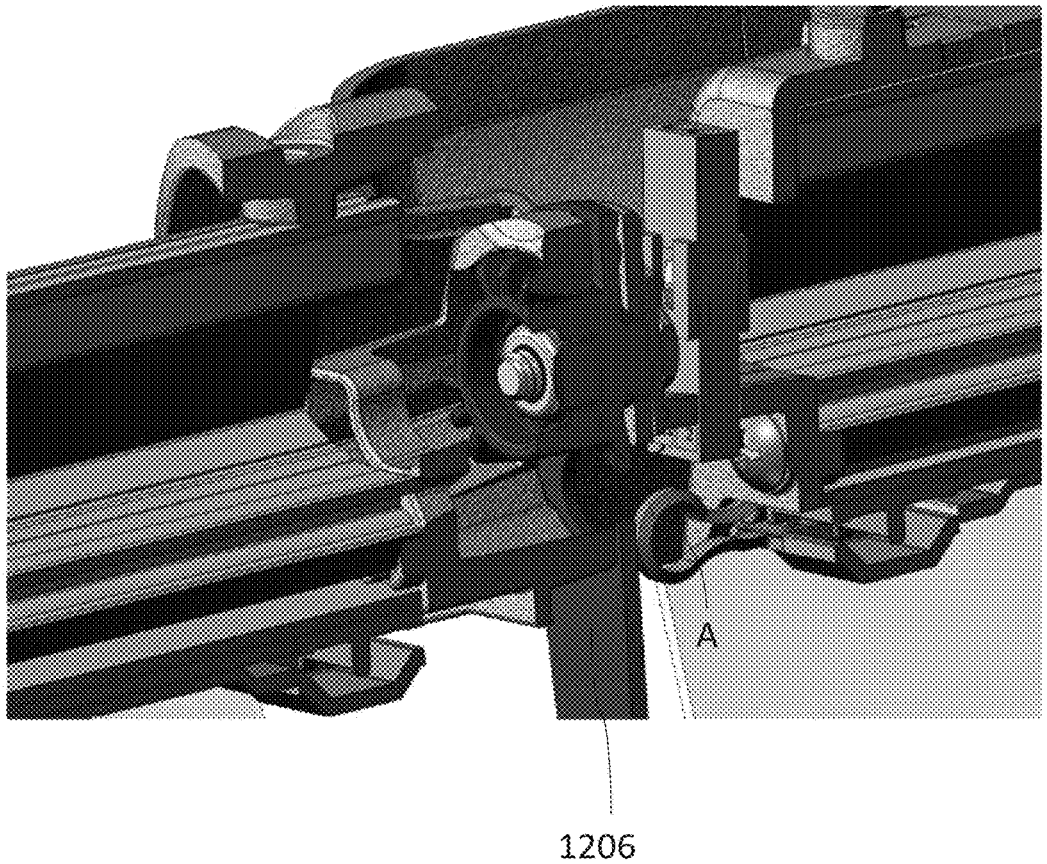

In FIG. 15B, as the cutaway view, the lever 1202 is brought into the Center Lock position where the handle 1206 is in a vertical position and the opening as indicated by the circle 'A' is smaller at side 1205*b* of the lever 1202. To indicate that the first and second linear light fixtures 100*a* and 100*b* have been mated together into a straight line.

Figure 13:
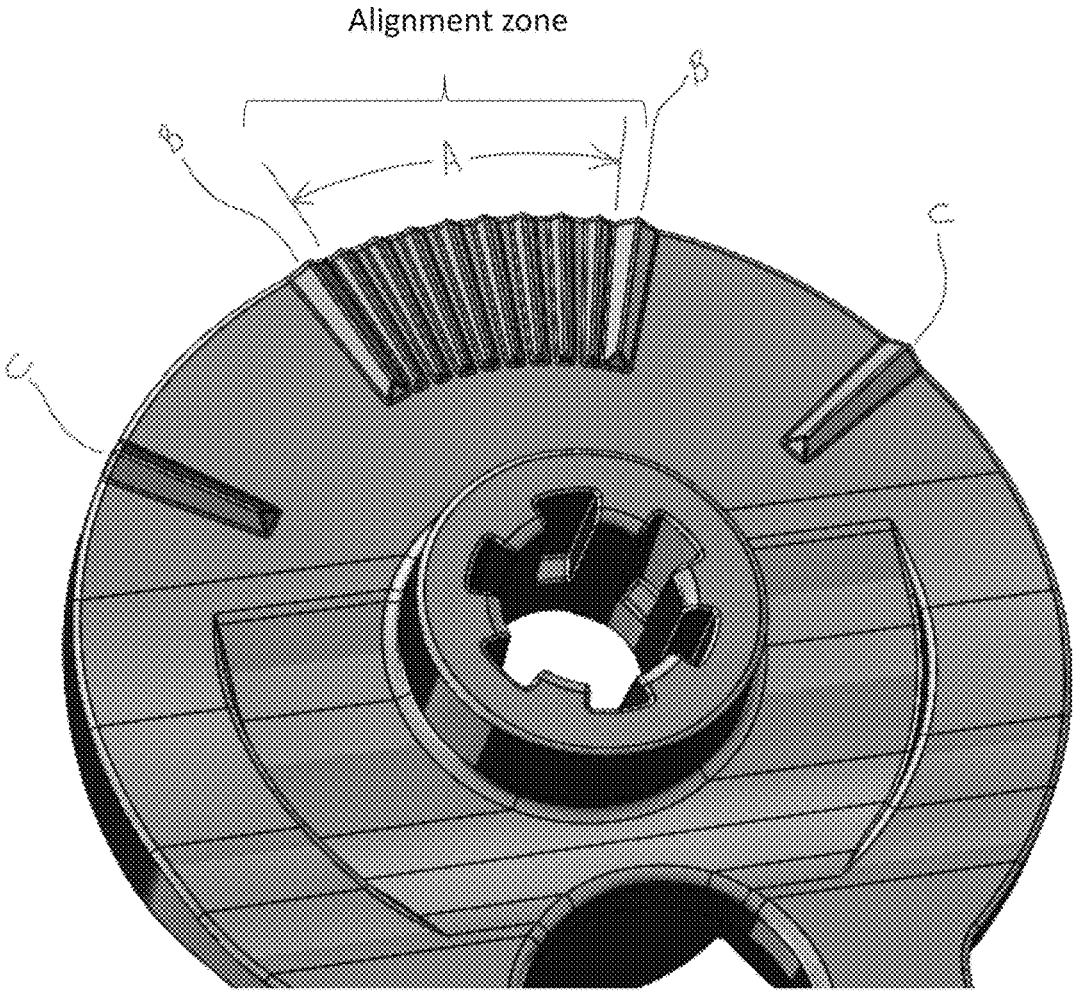
FIG. 13 illustrates a close up view of one side of a lever according to various aspects described herein.
Figure 16A:
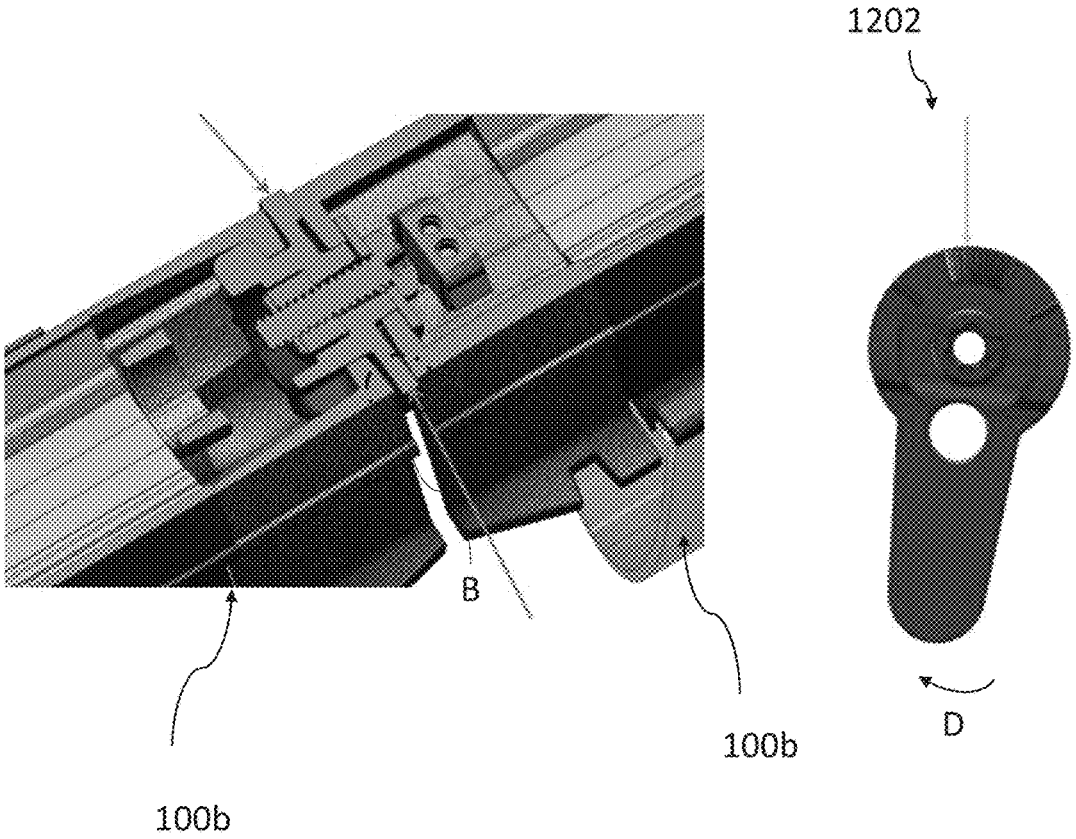
FIG. 16A illustrates a cutaway view of the lever slightly adjusted to a left position wherein the thickness of the sides are varied according to aspects described herein.
Figure 16B:
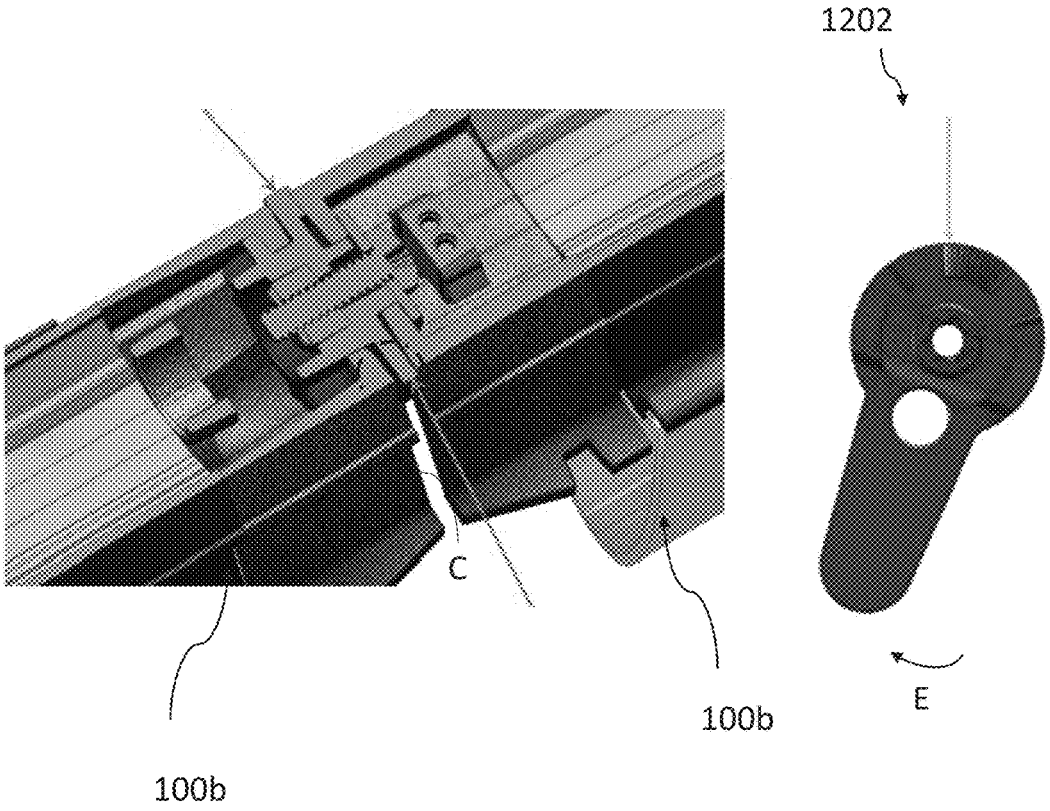
FIG. 16B illustrates a cutaway view of the lever at a maximum adjustment position wherein the thicknesses of the sides thereof are further varied than in FIG. 17, according to aspects described herein.

FIG. 16A shows a cutaway view illustrating the opening as indicated by circle 'B' being smaller as the lever 1202 is moved slightly to the left as indicated by arrow 'D'. In FIG. 16B, the lever 1202 is turned to a maximum adjustment position (i.e., at detent B as depicted in FIG. 13) as indicated by arrow 'E' to further align the linear light fixtures 100*a* and 100*b* if necessary.

Figure 17A:
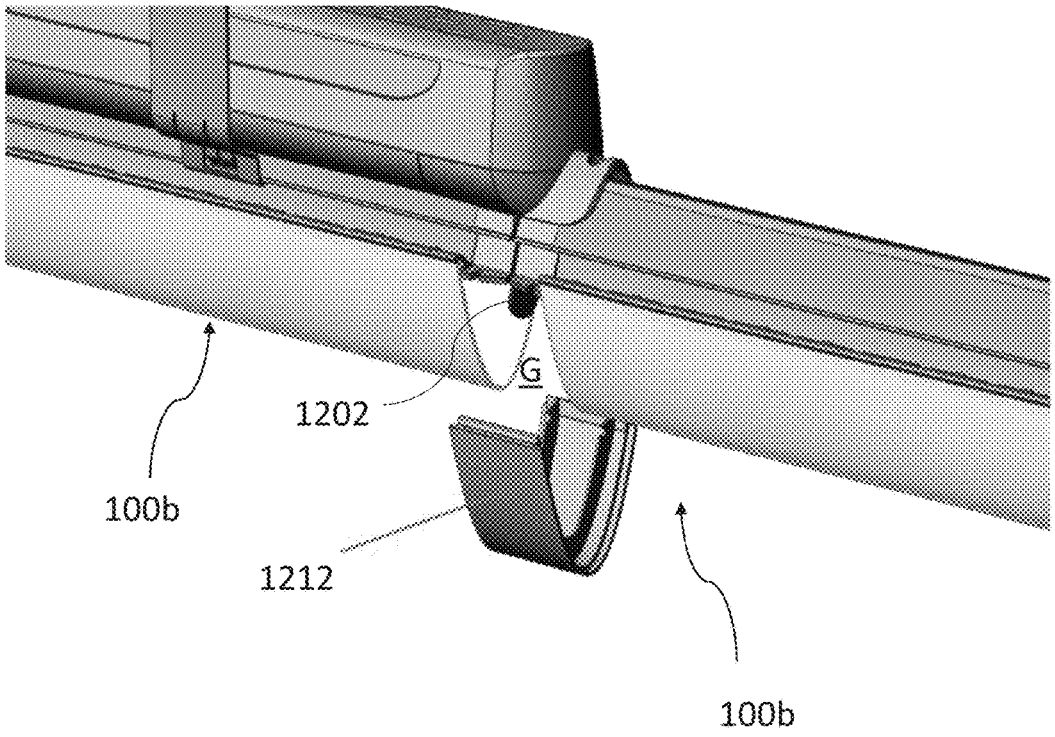
FIGS. 17A and 17B illustrate a center cover to be applied between two linear fixtures mated together according to aspects described herein.
Figure 17B:
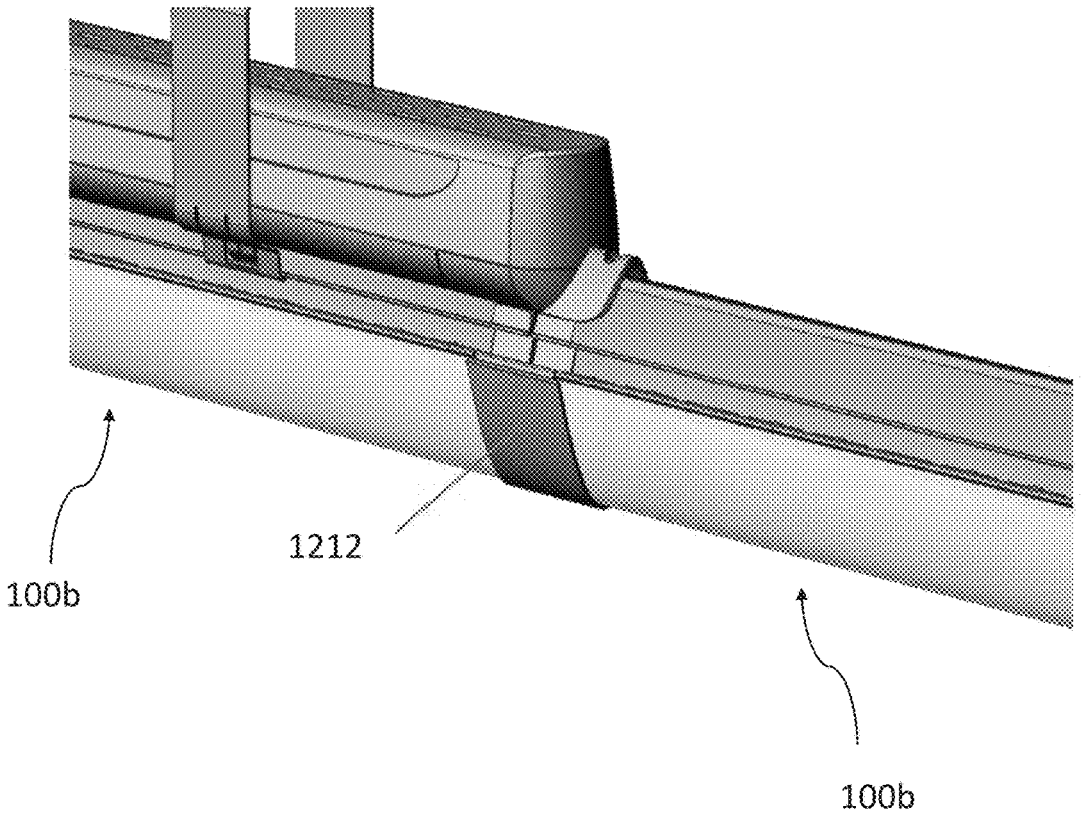

FIG. 17A illustrates the center cover 1212 for covering a gap 'G' left between the first and second linear light fixtures 100*a* and 100*b* when mated together. The center cover 1212 can be mounted when the lever 1202 is in the adjustment zone A. The center cover 1212 cannot be mounted if the lever 1202 is passes the 'B' detent.

It is noted that while the above-described embodiments provide a low-complexity mechanism for aligning light fixtures and preventing snaking, other embodiments can include more complex features while achieving the same function. For example, some embodiments can include adjustment screws, and thus a tool for making an adjustment between two adjacent light fixtures would thus be needed, which would consequently render fixture alignment and anti-snaking more involved than as has been described above.

The embodiments generally provide various advantages that prevent snaking and do not compromise ease and speed of installation and maintenance. Some of the advantageous features can be, for example and not by limitation, a lever that combines a mechanical attachment of two adjacent light fixtures in a continuous light fixture run. Further, in some embodiments, no tool is needed for securing two light fixtures together, and some embodiments can include a center notch for nominal alignment without compensation. As such, less precision is required and all the light fixtures in a continuous run can be aligned, thus preventing snaking.

Those skilled in the relevant art(s) will appreciate that various adaptations and modifications of the embodiments described above can be configured without departing from the scope and spirit of the disclosure. Therefore, it is to be understood that, within the scope of the appended claims, the disclosure may be practiced other than as specifically described herein.

What is claimed is:

1. A light fixture, comprising:

an end portion including a mechanism configured to lock the light fixture via the end portion to another end portion disposed at one extremity of another light fixture;

the mechanism including a lever configured to lock the light fixture with the other end portion;

the lever including a first portion having a first thickness that engages a receiving component on the light fixture, and a second portion having a second thickness that engages the other end portion, the lever rotatable perpendicular to its central axis;

wherein a rotation of the lever causes the receiving portion and the other end to move in opposite longitudinal directions.

2. The light fixture of claim 1, wherein the mechanism is configured to provide a tool-less attachment interface between the light fixture and the other light fixture.

3. The light fixture of claim 1, wherein the mechanism is configured to provide anti-snaking between the light fixture and the other light fixture.

4. The light fixture of claim 1, wherein the lever is configured to actuate in a first direction and a second direction.

5. The light fixture of claim 4, wherein the first direction is counter-clockwise and the second direction is counter-clockwise.

6. The light fixture of claim 1, wherein the lever is configured to actuate in a first direction to lock the light fixture to the other light fixture and in a second direction to unlock the light fixture from the other light fixture.

7. The light fixture of claim 1, wherein the mechanism further includes a feature configured to provide alignment between the light fixture and the other light fixture.

8. A light fixture assembly, comprising:

a set of light fixtures including at least one light fixture having one end connected to another light fixture;

a mechanism disposed between the end of the at least one light fixture and the other light fixture;

the mechanism including a lever configured to lock the at least one light fixture with an end portion of the other light fixture;

the lever including a first portion having a first thickness that engages a receiving component on the at least one light fixture, and a second portion having a second thickness that engages the other end portion, the lever rotatable perpendicular to its central axis;

wherein a rotation of the lever causes the receiving portion and the other end to move in opposite longitudinal directions.

9. The light fixture assembly of claim 8, wherein the mechanism is configured to provide a tool-less attachment interface between the at least one light fixture and the other light fixture.

10. The light fixture assembly of claim 8, wherein the mechanism is configured to provide anti-snaking between the at least one light fixture and the other light fixture.

11. The light fixture assembly of claim 8, wherein the lever is configured to actuate in a first direction and a second direction.

12. The light fixture assembly of claim 11, wherein the first direction is counter-clockwise and the second direction is counter-clockwise.

13. The light fixture assembly of claim 8, wherein the lever is configured to actuate in a first direction to lock the at least one light fixture to the other light fixture and in a second direction to unlock the at least one light fixture from the other light fixture.

14. The light fixture assembly of claim 8, wherein the mechanism further includes a feature configured to provide alignment between the at least one light fixture and the other light fixture.

15. The light fixture assembly of claim 14, wherein the alignment provides a substantially straight line between the at least one light fixture and the other light fixture.

16. The light fixture assembly of claim 8, wherein the at least one light fixture and the other light fixture are each a linear light fixture.

* * * * *